US006302785B1

(12) United States Patent
McKinney et al.

(10) Patent No.: US 6,302,785 B1
(45) Date of Patent: Oct. 16, 2001

(54) FOUNDATION VENT WITH IMPROVED NET FREE VENTILATION AREA

(75) Inventors: Richard McKinney, Ellijay; J. Charles Headrick, Alpharetta, both of GA (US)

(73) Assignee: Headrick Building Products, Inc., Cumming, GA (US)

( * ) Notice: Subject to any disclaimer, the term of this patent is extended or adjusted under 35 U.S.C. 154(b) by 0 days.

(21) Appl. No.: 09/592,361

(22) Filed: Jun. 12, 2000

(51) Int. Cl.[7] ..... F24F 13/12

(52) U.S. Cl. ..... 454/334; 160/369; 160/379; 454/274

(58) Field of Search ..... 454/274, 275, 454/276, 283, 334; 160/369, 379

(56) References Cited

U.S. PATENT DOCUMENTS

| | | | | |
|---|---|---|---|---|
| D. 321,557 | | 11/1991 | Bezick et al. | D23/393 |
| 1,493,875 | * | 5/1924 | Frederick | 454/274 |
| 1,876,689 | * | 9/1932 | Kelly | 454/334 X |
| 1,939,312 | * | 12/1933 | Murray | 454/274 X |
| 2,587,509 | * | 2/1952 | Moyer et al. | 454/283 X |
| 3,130,659 | * | 4/1964 | Compton et al. | 454/276 |
| 4,127,156 | * | 11/1978 | Brandt | 160/369 X |
| 4,274,330 | | 6/1981 | Witten et al. . | |
| 4,290,554 | | 9/1981 | Hensley | 236/49 |
| 4,328,927 | | 5/1982 | McSwain | 236/49 |
| 4,381,630 | | 5/1983 | Koester | 52/169.5 |
| 4,493,456 | | 1/1985 | Sarazen, Jr. et al. | 236/49 |
| 4,587,892 | | 5/1986 | Witten et al. . | |
| 4,592,271 | | 6/1986 | Young . | |
| 4,676,145 | | 6/1987 | Allred . | |
| 4,699,045 | | 10/1987 | Hensley . | |
| 4,711,160 | | 12/1987 | Witten et al. . | |
| 4,715,532 | | 12/1987 | Sarazen, Jr. et al. | 236/49 |
| 4,754,696 | | 7/1988 | Sarazen et al. . | |
| 4,768,424 | | 9/1988 | Frenkler et al. . | |
| 4,785,596 | | 11/1988 | Wiley et al. | 52/302 |
| 4,821,628 | | 4/1989 | Sarazen, Jr. et al. . | |
| 4,877,182 | | 10/1989 | Pugh et al. | 236/44 |
| 4,953,450 | | 9/1990 | Remondino . | |
| 4,962,882 | | 10/1990 | Sarazen, Jr. et al. | 236/49.5 |
| 5,094,054 | | 3/1992 | Arends | 52/302 |
| 5,203,795 | | 4/1993 | Balamut et al. | 52/303 |
| 5,236,124 | | 8/1993 | Orbesen | 236/49.1 |
| 5,349,799 | * | 9/1994 | Schiedegger et al. | 454/283 X |
| 5,410,844 | | 5/1995 | Lynch | 52/63 |
| 5,460,572 | | 10/1995 | Waltz et al. | 454/273 |
| 5,496,213 | | 3/1996 | Miller | 454/271 |
| 5,538,558 | | 7/1996 | Ookouchi et al. | 118/423 |
| 5,662,288 | | 9/1997 | Chiang | 242/596.8 |
| 5,881,951 | | 3/1999 | Carpenter | 236/44 |

FOREIGN PATENT DOCUMENTS

| | | | | |
|---|---|---|---|---|
| 961 295-A | * | 4/1957 | (DE) | 454/334 |

* cited by examiner

*Primary Examiner*—Harold Joyce
(74) *Attorney, Agent, or Firm*—Womble Carlyle Sandridge & Rice, PLLC

(57) ABSTRACT

An improved foundation vent with increased net free area is provided. The foundation vent has a frame that surrounds and defines an opening and a grill supported by the frame and spanning the opening. The grill has an inside face disposed on the inside of a crawlspace when the vent is mounted in a foundation wall and an outside face disposed on the outside of the crawlspace. A mesh screen is mounted to the frame and spans the opening adjacent the inside face of the grill. The grill is provided with projecting standoffs that support the screen at a predetermined distance from the inside face of the grill to form a plenum between the screen and the grill. A raised peripheral rim is provided on the frame and supports the peripheral portion of the screen. The spacing of the screen from the inside face of the grill and the plenum formed thereby unblocks the portions of the screen that otherwise would be blocked by the members of the grill and thus increases the net free area of the foundation vent.

2 Claims, 4 Drawing Sheets

FOUNDATION VENT WITH IMPROVED NET FREE VENTILATION AREA

BACKGROUND

1. Field of the Invention

The present invention relates generally to ventilation of crawlspaces beneath buildings and more specifically to foundation vents for installation in the foundation of a building to provide crawlspace ventilation.

2. Background of the Invention

Ventilation of the crawlspace beneath a building is imperative to prevent moisture build-up and consequent moisture damage to floor joist, rim joists, decking, and other structural elements exposed to the crawlspace. Ventilation also helps to prevent the build-up within the crawlspace of potentially harmful or explosive gasses such as methane, natural gas, ozone, and sewer gas. A variety of methods of providing crawlspace ventilation have been used over the years. Many early homes, fore example, were simply built upon brick pilings so that the crawl space was open around the periphery of the house. Obviously, no ancillary ventilation is required in this type of building construction. In more recent years, homes have been built upon raised foundation walls, which are visually more appealing than open foundations but that also create a closed crawlspace beneath the home that must be ventilated. Early attempts to provide crawlspace ventilation generally were very crude and usually involved leaving open ventilation holes at selected locations around the foundation. While such ventilation holes do provide ventilation, they nevertheless are problematic because, among other things, they provide an opening through which insects and vermin can enter the crawlspace. Further, holes in the foundation provide no means of regulating the amount of ventilation, which is important in cold weather to conserve heat and prevent freezing of substructural plumbing.

In more modern times, foundation vents have been developed. Foundation vents are designed to be built into the foundation walls of a home or other building to provide reliable and regulatable crawlspace ventilation. While foundation vents are available in a wide variety of designs, in general they include a frame that is securable within an opening in a foundation wall. Typically, the frame is rectangular in shape and is conveniently sized to fit within the space normally occupied by a cinder block of the foundation wall. The frame surrounds and supports a grill structure, which allows air flow through the vent but deters entry into the crawlspace of mice, squirrels, chipmunks, and other small vermin. In order to prevent entry into the crawlspace of relatively smaller insects such as roaches and bees, most foundation vents also are provided with a mesh screen mounted to the back side of the grill. Finally, an adjustable air flow regulator is provided for selective restriction of the amount of air that flows through the vent. Air flow regulators can take a variety of forms in foundation vents, but two of the most common are a sliding shudder mechanism and an inwardly hinging damper that can be opened and closed by a handle. In either case, the foundation vent can be fully or partially opened or completely closed as desired.

Early foundation vents generally were fabricated from metal with their frames and grills, for example, being made of cast aluminum and with components such as damper panels being made of stamped sheet aluminum. With the advent of improved weather resistant plastics, however, many foundation vents today, especially in residential construction, are made of injection molded plastic. Nevertheless, the design and function of plastic foundation vents is substantially the same as that of their metal predecessors.

An important functional consideration when designing foundation vents is the "net free area" of the vent. Net free area refers to the total amount of open or free area provided for the flow or air through the vent. For example, a rectangular opening in a foundation wall with no foundation vent installed has a net free area equal to the product of the length and width of the opening. When a foundation vent is installed, however, the frame, grill structures, and screen of the vent cover and block some of the opening, thus reducing the net free area available for the flow or air. In fact, it is not unusual for a foundation vent to have a net free area that is half or even less that of the opening in which it is installed.

Foundation vents with smaller net free areas impose the requirement on builders that more vents be installed to accomplish a given total air flow through a crawlspace. The required installation of more vents is undesirable because of the extra cost of vents and, more importantly, the additional time and labor costs associated with installing more vents. Thus, designers of foundation vents strive to maximize the net free area of their vents by optimizing the frame and grill structures of the vents. However, there are inherent limits to the amount that net free area can be increased because of constraints imposed by structural requirements and the requirement that a vent's grill openings be small enough to prevent vermin from entering through the vent. Accordingly, the frame and grill structures of modern foundation vents generally are already optimized to provide the maximum possible net free area allowed by design constraints.

To make matters worse, the mesh screens mounted to the back surfaces of the grill of a foundation vent covering the grill openings reduces net free area even further. In modern plastic foundation vents, the screens generally are secured by being sonically welded or hot staked to the back of the grill and around the rim of the frame. While the individual aluminum or fiberglass strands of the screen appear small to the eye, their combined area can, in fact, block a significant portion of the grill openings and reduce the net free area of the vent by up to twenty percent (20%). Unfortunately, the mesh screen can not be eliminated because it is required to prevent entry of insects into the crawlspace.

Clearly, there exists a need for a foundation vent that meets all of the pre-imposed requirements of structural integrity and pest impenetrability while at the same time presenting a net free area to the flow of air that is substantially increased over that presented by existing prior art foundation vents. Such a foundation vent also should be economical to produce, easy to install, selectively openable and closable as needed, and, due to its increased net free area, reduce the required number of vents that a contractor must install to obtain a total required crawlspace airflow. It is to the provision of such a foundation vent that the present invention is primarily directed.

SUMMARY OF THE INVENTION

Briefly described, the present invention, in a preferred embodiment thereof, comprises an improved foundation vent for installation in the foundation of a building structure to provide crawlspace ventilation. The vent includes a frame, which is rectangular in the preferred embodiment, with the frame defining a central opening. A grill is supported by the frame and spans the opening. In one embodiment, the grill comprises an array of spaced apart vertically extending ribs that define openings therebetween and in another embodiment the grill is formed by a set of spaced apart crisscrossing grill members. In any event, the openings defined by the grill are sized to prevent entry through the grill of relatively larger pests and vermin while allowing air to pass through the grill. A mechanism for selectively opening up and closing off the grill is provided. This mechanism may, for example, be a sliding shudder mechanism, a hinged damper mechanism, or other appropriate mechanism controlling the air flow through the foundation vent.

A mesh screen is mounted to the foundation vent, preferably adjacent the inside face of the grill. Unlike the screen of prior art vents, however, the mesh screen of the present invention is not mounted to the members that form the grill, but instead is supported at a predetermined spaced distance from the face of the grill to form a plenum between the screen and the grill. In order to provide for this spacing, an array of standoffs are formed on the grill members and project therefrom to support the mesh screen. The standoffs may take on a variety of configurations such as, for example, vertically extending ribs, a matrix of posts, or otherwise. In any event, the mesh screen may be mounted to the standoffs by hot staking, sonic welding, or otherwise to support the mesh screen at its predetermined distance from the grill. Preferably, a peripheral support rim extends at least partially around the opening of the vent and is sized to support the periphery of the mesh screen. The mesh screen may be hot staked or welded to the peripheral support rim. Thus, the mesh screen is securely mounted to the vent spanning the opening and is supported at a predetermined distance from the grill by the standoffs and peripheral support rim.

Since the mesh screen in the present invention is spaced from the grill forming a plenum, the portion of the mesh screen that in prior art grills is disposed against and thus closed off by the surfaces of the grill members is opened up. Accordingly the entire surface area of the screen is available for air flow through the screen instead of just the portions spanning the grill openings between the grill members. That is, air flow passes through the entire surface area of the screen and into the plenum, from where it can pass through the grill. Thus, the net free area of the mesh screen is increased substantially by spacing the mesh screen from the grill of the vent. In fact, the increase in net free area of the screen usually is greater than the percentage of the grill openings normally closed and blocked by the combined area of the screen elements spanning these openings. As a result, the constriction of the grill openings is essentially eliminated and the net free area of the vent as a whole is increased significantly.

Thus, a foundation vent is now provided that successfully addresses the problems and shortcomings of prior art vents. More specifically, the vent satisfies all of the structural and pest impenetrability requirements imposed on foundation vents and, at the same time, offers substantially increased net free area through which air may flow into and out of a crawlspace. The result is enhanced ventilation and a consequent reduction in the total number of foundation vents required for a given size crawlspace. The vent of this invention may be selectively opened up and closed off just as prior art vents to control air flow as needed and is simple to manufacture, easy to install, and offers years of maintenance-free reliability. These and other objects, features, and advantages of the foundation vent of this invention, and of the unique method of enhancing the flow therethrough, will be better appreciated upon review of the detail description set forth below when taken in conjunction with the accompanying drawing figures, which are briefly described as follows.

DETAILED DESCRIPTION OF THE PREFERRED EMBODIMENTS

Figure 1:
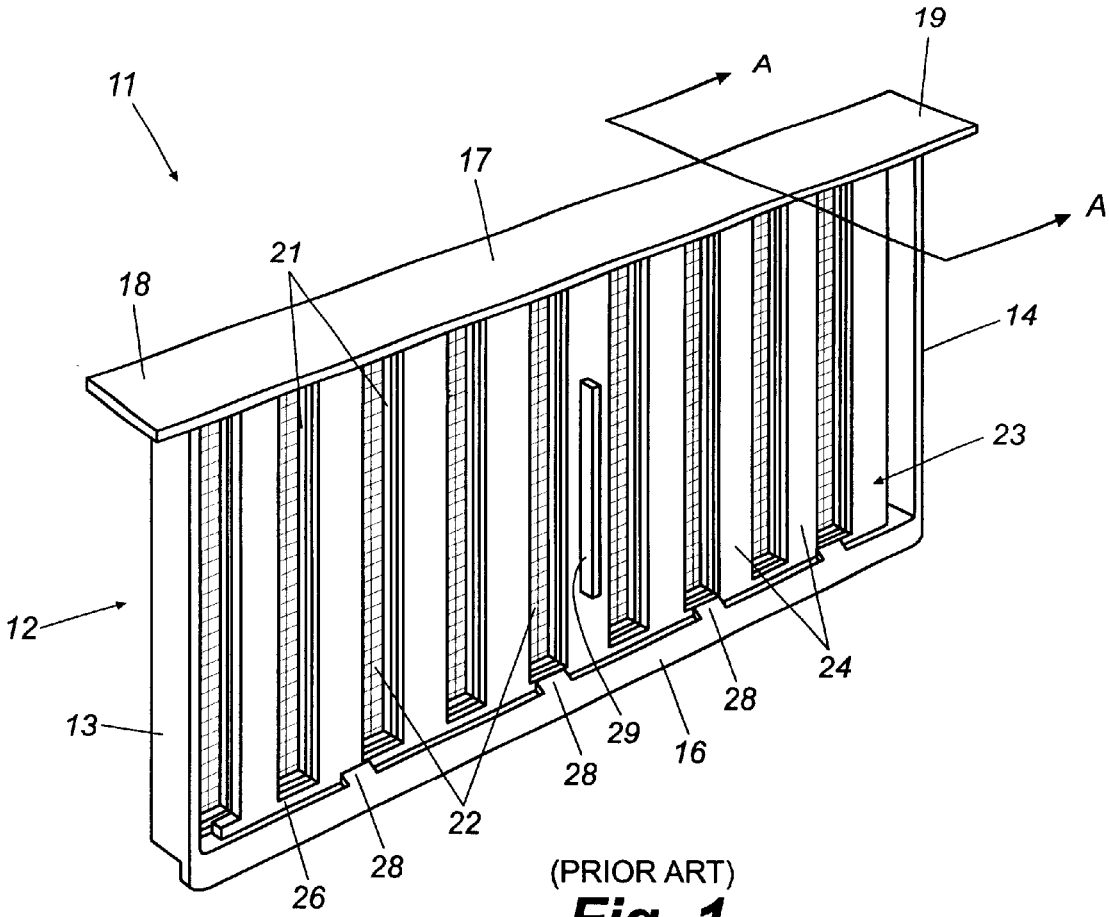
(PRIOR ART) Fig. 1
FIG. 1 is a perspective illustration of a typical prior art sliding shudder type foundation vent
Figure 2:
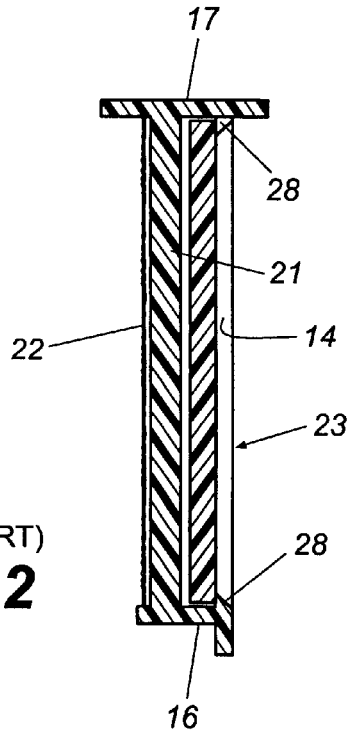
(PRIOR ART) Fig. 2
FIG. 2 is a cross-sectional view of the foundation vent of FIG. 1 taken along line A—A thereof.

Referring now in more detail to the drawing figures, in which like numerals refer to like parts throughout the several views, FIGS. 1 and 2 illustrate a prior art shudder-type foundation vent to which the present invention may be considered an improvement. The foundation vent 11, which preferably is made of injection molded plastic, has a frame 12 consisting of a left side member 13, a right side member 14, and a bottom member 16. A lentil 17 forms the top of the frame and has projecting ears 18 and 19 for securing the vent in place within a foundation wall.

A grill spans the space defined by the frame and is formed from an array of spaced apart vertical louvers or grill members 21. The grill members 21 extend between the bottom side member 16 and the lentil 17 and define openings therebetween through which air can pass to provide ventilation of a crawlspace. As best illustrated in FIG. 2, a mesh screen 22, which may be made of aluminum, fiberglass, or another appropriate material, is secured to the backs of the grill members by means, for example, of heat staking or sonic welding. Usually, the mesh screen 22 is also secured around the inner periphery of the frame 12 as well.

A shudder 23 is mounted within the frame 12 and is slidably held in place by a set of tabs 28 formed on the outside of the frame. The shudder 23 has an array of spaced apart vertical shudder elements 24 that are sized and spaced apart to correspond to the size and spacing of the vertical grill members 21. A projecting handle 29 is formed on one of the shudder elements to facilitate the manual sliding of the shudder 23 back and forth between the sides 13 and 14 of the frame 11. In use, the shudder may be slid to the position shown in FIG. 1 wherein the shudder elements align with the grill members and the spaces between the shudder elements align with the spaces between the grill members. In this "open" position, air is free to flow through the spaces between the grill members and the shudder elements to provide ventilation. When it is desired to close the vent, the shudder is slid to a closed position wherein the shudder elements align with and block the spaces between the grill members to prevent the flow of air through the vent. The vent may be closed, for example, in the winter to prevent freezing temperatures from developing in a crawlspace.

As mentioned above, a long standing problem with prior art foundation vents such as the vent 11 is that the mesh screen attached to the back surfaces of the grill members partially blocks the spaces between these members. In fact, up to about 20 percent of the total area of each space can be blocked by the composite area of the screen elements that span the space. As a result, the net free area available for air flow through the foundation vent is reduced significantly by the elements of the mesh screen.

Figure 3:
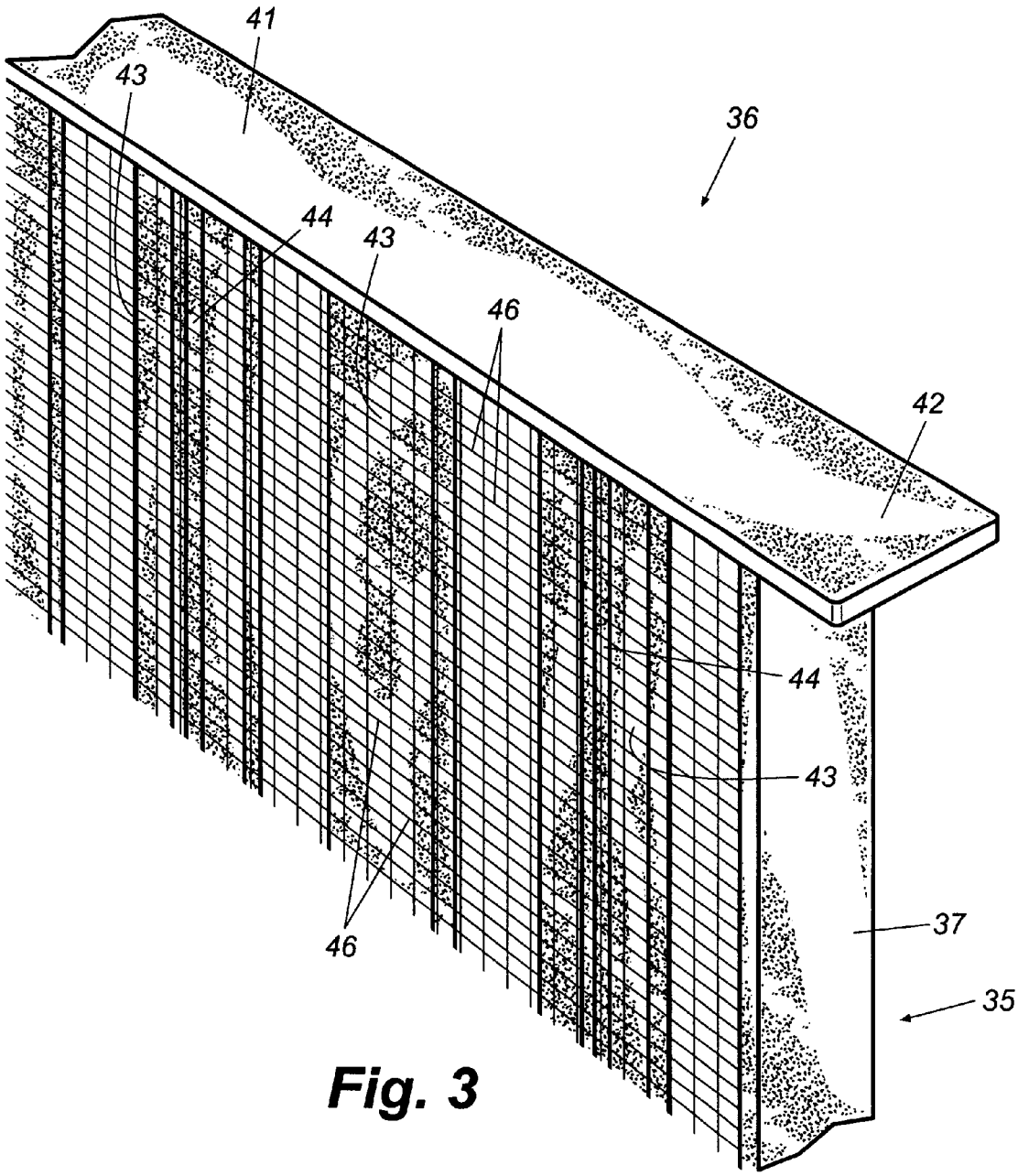
FIG. 3 is a perspective view of a portion of the back of a foundation vent that embodies principles of the present invention in a preferred form.
Figure 4:
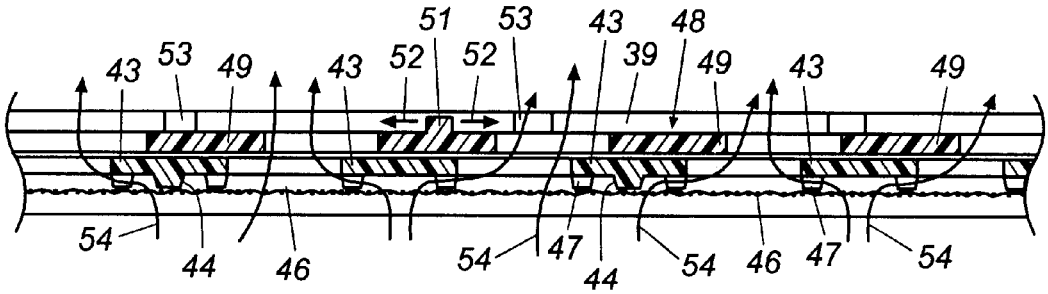
FIG. 4 is a longitudinal section view of a section of a sliding shudder foundation vent that embodies principles of the invention.
Figure 5:
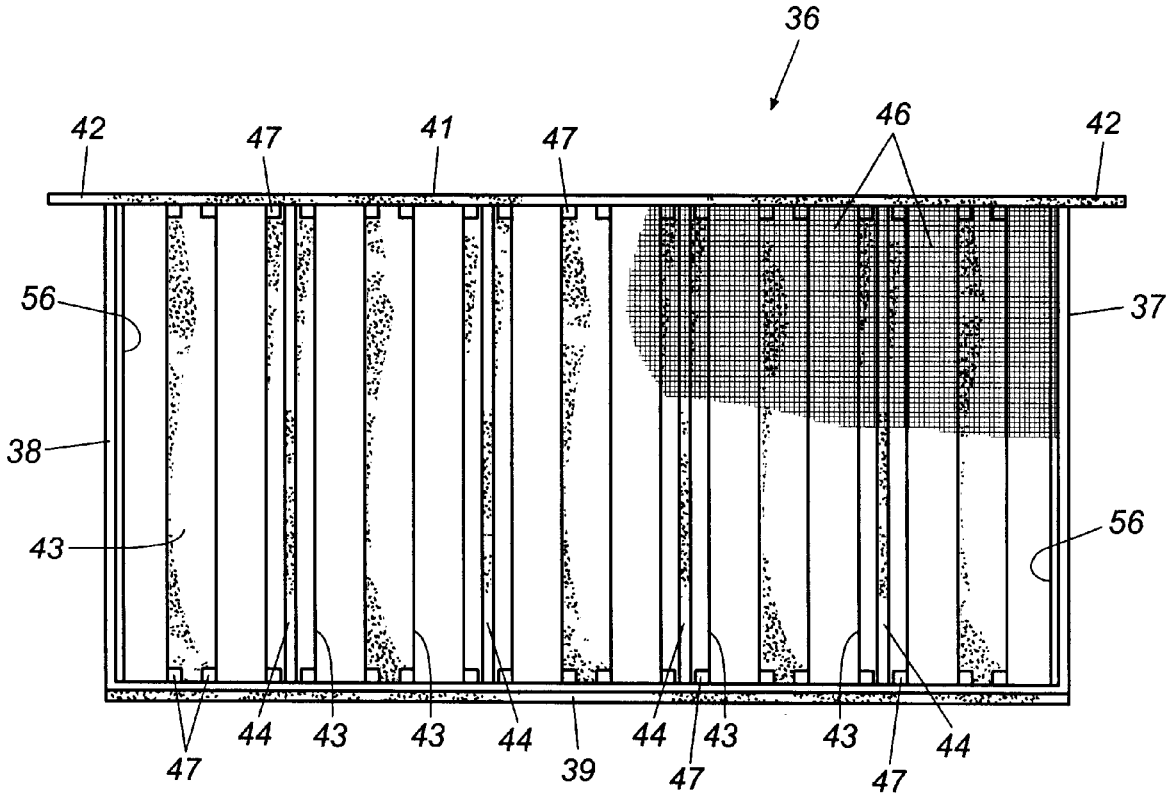
FIG. 5 is a back plan view of a sliding shudder foundation vent that embodies principles of the invention.

FIGS. 3 through 5 illustrate a shudder-type foundation vent that embodies principles of the present invention to regain the net free area lost in prior art vents due to the mesh screen. The foundation vent 36 has a frame 35 formed by a left (as seen from the front) side member 37, a right side member 38, a bottom member 39 and a lentil 41. A grill spans the space defined by the frame and is formed from an array of vertically extending spaced apart grill members 43. At least some of the grill members are formed on their back sides with projecting standoffs in the form of vertical ribs 44, which extend the length of their respective grill members. Projecting posts or tabs 47 are formed at the top and bottom ends of the grill members (FIG. 5) and the tabs 47 project from the grill members a distance corresponding to the distance that the ribs 44 project from their grill members. A raised rim 56 is formed on the insides of the side members 37 and 38 and is aligned with the ribs 44 and the tabs 47 on the respective grill members 43.

A mesh screen 46 spans the space defined by the frame 35 on the inside of the foundation vent. The mesh screen, which again may be formed of aluminum, fiberglass, or another appropriate material, is attached to the ribs 44, tabs 47, and raised rims 56 by means, for example, of heat staking or sonic welding. Since the ribs, tabs, and rims all project a predetermined distance from the back surfaces of the grill members, the mesh screen attached thereto is supported at a predetermined spaced distance from the grill members, as best illustrated in FIG. 4. While the spacing of the mesh screen from the grill members may be any selected distance, it has been found that a spacing of 0.150 inches provides the benefits of the present invention without adding to the overall thickness of the foundation vent. As in prior art shudder vents, a shudder 48 is slidably mounted in the frame and can be selectively slid in the direction indicated by arrows 52 to open up or close off the vent as necessary.

Referring to FIG. 4, it will be seen that since the mesh screen 46 is supported at a spaced distance from the back surfaces of the grill members 43, the portions of the screen aligned with the grill members are not blocked by the grill members as in prior art vents. The space between the mesh screen and the grill members may be thought of as a plenum. Thus, air is free to flow as indicated at 54 not only directly through the spaces between the grill members and the portions of the mesh screen aligned therewith, but also through the portions of the screen aligned with the grill members, into the plenum, and out through the grill openings. In essence the net free area of the mesh screen itself, that is; the area available for air flow, is increased by the total combined area of the grill members.

In most vent designs, the increased net free area of the mesh screen as a result of spacing it from the grill members is greater than the area of the grill openings normally blocked by the mesh screen in prior art vents. As a result, the normally lost area is recovered in the foundation vent of this invention and the net free area of the vent is increased to approximately the total combined areas of the grill openings as if no mesh screen at all were present. In practice, this means that the foundation vent 11 of the present invention boasts a net free area up to about twenty percent (20%) greater than that of prior art shudder-type foundation vents. This, in turn, means that fewer foundation vents need be installed in a foundation wall to provide a given ventilation of a crawlspace enclosed by the wall.

Figure 6:
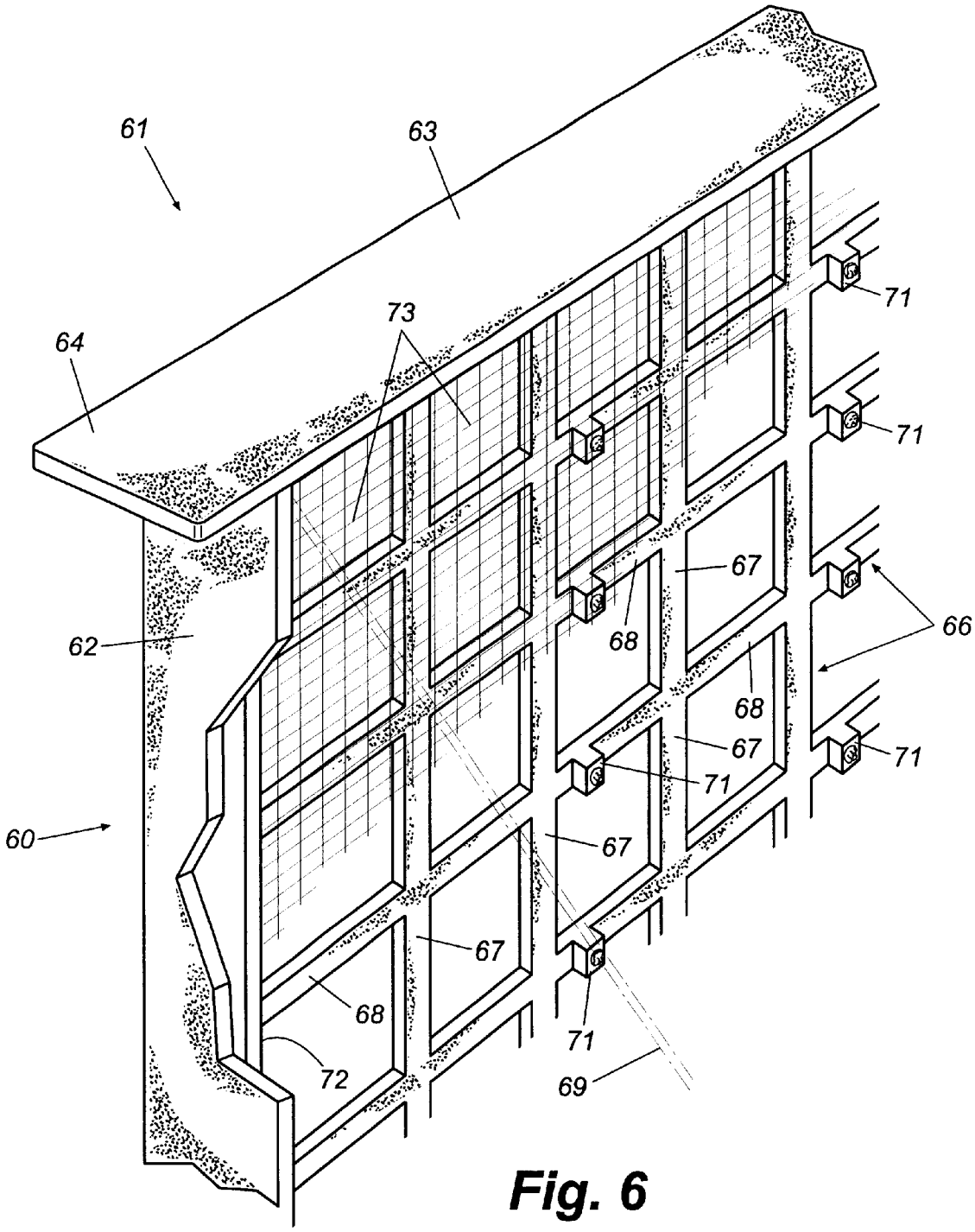
FIG. 6 is a perspective partially cut-away view of a portion of a damper type foundation vent that embodies principles of the invention.

FIG. 6 illustrates another common type of foundation vent that embodies principles of the invention. The foundation vent 61, which preferably is formed of injection molded plastic, has a frame 60, formed with side members 62, a bottom member (not visible), and a lentil 63 having ears 64. A damper panel 69 (shown in phantom lines) is hingedly attached to the tops of the sides 62 and may be opened or closed by means of a handle (not shown) as is known in the art. A grill 66 spans the opening defined by the frame 60 and is formed by a plurality of crisscrossing vertical grill members 67 and horizontal grill members 68, which define grill openings. A plurality of standoffs in the form of projecting posts 71 are formed on the backs of at least some of the grill members and preferably project a distance of about 0.150 inches from their respective grill members. A raised rim 72 is formed around at least part of the inner periphery of the frame 60 and the rim 72 is aligned with the projecting posts 71.

A mesh screen 73 spans the opening of the vent and is disposed behind the grill 66. The mesh screen is secured by means of heat staking or the like to the projecting posts 71 and to the raised rim 72 around the inner periphery of the frame. It will thus be seen that, as in the previous embodiment, the mesh screen is supported by the posts and the raised rim at a spaced distance from the back of the grill such that a plenum is formed between the mesh screen and the grill. Accordingly, the areas of the mesh screen normally blocked by the grill members 67 and 68 in prior art vents is opened up and available for the flow of air. The net free area of the mesh screen is therefore increased by the combined areas of the grill members just as in the previous embodiment. As a result, the free area of the grill openings that is blocked by the mesh screen is recovered and the total net free area of the foundation vent itself is increased proportionally. A foundation vent with enhanced net free area and all of the advantages thereof is thus provided.

The invention has been described herein in terms of preferred embodiments and methodologies. It will be understood by those of skill in the art, however, that a variety of variations of the illustrated embodiments may be made within the scope of the invention. For example, while rectangular foundation vents are illustrated, the invention also is applicable to foundation vents of any shape. Further, the mesh screen of foundation vents usually is on the inside portion of the vent, and this has been illustrated in the preferred embodiments. However, the screen may also be mounted on the outside of the vent if desired without detracting from the benefits of the invention. Finally, while the configurations of the standoffs in the illustrated embodiments are considered by the inventors to be the best mode of carrying out the invention, any other configuration may be selected so long as the mesh screen is held at a predetermined spaced distance from the grill. These and other additions, deletions, and modifications may well be made to the illustrated embodiments by those of skill in the art without departing from the spirit and scope of the invention as set forth in the claims.

What is claimed is:

1. A foundation vent comprising:

a frame defining an opening;

a grill supported by said frame spanning said opening;

a screen mounted to said foundation vent on one side of said grill, said screen being spaced a predetermined distance from said grill;

an array of standoffs projecting from said grill, said standoffs supporting said screen at said predetermined distance from said grill; and wherein said grill includes an array of spaced parallel louvers and wherein said standoffs comprise ribs projecting from one side of at least some of said louvers.

2. A foundation vent comprising:

a frame defining an opening;

a grill supported by said frame spanning said opening;

a screen mounted to said foundation vent on one side of said grill, said screen being spaced a predetermined distance from said grill;

an array of standoffs projecting from said grill, said standoffs supporting said screen at said predetermined distance from said grill; and wherein said grill includes an array of crisscrossing members and wherein said standoffs comprise a set of posts projecting from at least some of said members.

* * * * *